US008599093B2

(12) United States Patent
Ridgeway

(10) Patent No.: US 8,599,093 B2
(45) Date of Patent: Dec. 3, 2013

(54) WIDEBAND ANTENNA FOR PRINTED CIRCUIT BOARDS

(75) Inventor: Robert Wayne Ridgeway, Saratoga Springs, UT (US)

(73) Assignee: Digi International Inc., Minnetonka, MN (US)

( * ) Notice: Subject to any disclaimer, the term of this patent is extended or adjusted under 35 U.S.C. 154(b) by 384 days.

(21) Appl. No.: 12/952,669

(22) Filed: Nov. 23, 2010

(65) Prior Publication Data

US 2011/0122043 A1 May 26, 2011

Related U.S. Application Data

(60) Provisional application No. 61/264,109, filed on Nov. 24, 2009.

(51) Int. Cl.
*H01Q 1/50* (2006.01)

(52) U.S. Cl.
USPC ..... 343/860

(58) Field of Classification Search
USPC ..... 343/860, 702, 700 MS; 29/601
See application file for complete search history.

(56) References Cited

U.S. PATENT DOCUMENTS

| | | | | |
|---|---|---|---|---|
| 6,515,629 | B1 * | 2/2003 | Kuo et al. | 343/700 MS |
| 6,529,168 | B2 * | 3/2003 | Mikkola et al. | 343/702 |
| 6,611,235 | B2 * | 8/2003 | Barna et al. | 343/702 |
| 6,734,825 | B1 * | 5/2004 | Guo et al. | 343/700 MS |
| 6,759,984 | B2 | 7/2004 | Wielsma | |
| 7,034,750 | B2 | 4/2006 | Asakura et al. | |
| 7,541,984 | B2 * | 6/2009 | Peng et al. | 343/700 MS |
| 7,903,035 | B2 * | 3/2011 | Mikkola et al. | 343/702 |
| 8,179,322 | B2 * | 5/2012 | Nissinen | 343/700 MS |
| 2002/0175866 | A1 * | 11/2002 | Gram | 343/702 |
| 2006/0081466 | A1 * | 4/2006 | Nagashima et al. | 204/298.16 |

FOREIGN PATENT DOCUMENTS

| | | | |
|---|---|---|---|
| EP | 1398847 | A1 | 3/2004 |
| EP | 1475859 | A1 | 11/2004 |
| WO | WO-2005076407 | A2 | 8/2005 |
| WO | WO-2011066303 | A1 | 6/2011 |

OTHER PUBLICATIONS

"International Application No. PCT/US2010/057841, International Search Report and Written Opinion mailed Mar. 21, 2011", 11 pgs.
Yanagi, Masahiro, et al., "A Planar UWB Monopole Antenna Formed on a Printed Circuit Board", 1 pg.
Yang, H.Y. David, "Printed Straight F Antennas for WLAN and Bluetooth", Dept. of Electrical and Computer Engineering, Univ. of Illinois at Chicago, 4 pgs.

* cited by examiner

*Primary Examiner* — Huedung Mancuso
(74) *Attorney, Agent, or Firm* — Fogg & Powers LLC

(57) ABSTRACT

A planar antenna, such as included as a portion of a wireless communication assembly, can include a dielectric portion, a first conductive portion, extending along a surface of the dielectric portion, and a second conductive portion, parallel to the first conductive portion, extending along the surface of the dielectric portion, the second conductive portion laterally offset from the first portion to provide a specified lateral separation between the first and second conductive portions. The first and second conductive portions can be configured to provide respective resonant operating frequencies ranges offset from each other, and the first and second conductive portions can be configured to follow a commonly-shared path, including at least one bend, along the surface of the dielectric portion.

20 Claims, 6 Drawing Sheets

WIDEBAND ANTENNA FOR PRINTED CIRCUIT BOARDS

CLAIM OF PRIORITY

This patent application claims the benefit of priority, under 35 U.S.C. Section 119(e), to Ridgeway, U.S. Provisional Patent Application Ser. No. 61/264,109, entitled "WIDEBAND ANTENNA FOR PRINTED CIRCUIT BOARDS," filed on Nov. 24, 2009, which is hereby incorporated by reference herein in its entirety.

TECHNICAL FIELD

This document pertains generally, but not by way of limitation, to antennas for printed circuit board assemblies.

BACKGROUND

Information can be wirelessly transferred using electromagnetic waves. Generally, such electromagnetic waves are either transmitted or received using a specified range of frequencies, such as established by a spectrum allocation authority for a location where a particular wireless device or assembly will be used or manufactured. Such wireless devices or assemblies generally include one or more antennas, and each antenna can be configured for transfer of information at a particular range of frequencies. Such ranges of frequencies can include frequencies used by wireless digital data networking technologies. Such technologies can use, conform to, or otherwise incorporate aspects of one or more of the IEEE 802.11 family of "Wi-Fi" standards, one or more of the IEEE 802.16 family of "WiMax" standards, one or more of the IEEE 802.15 family of personal area network (PAN) standards, or one or more other protocols or standards, such as for providing cellular telephone or data services, fixed or mobile terrestrial radio, satellite communications, or other applications. For example, in the United States, various ranges of frequencies are allocated for low-power industrial, scientific, or medical use (e.g., an "ISM" band.), such as including a first ISM band in the range of about 902 MHz to 928 MHz, or including a second ISM band in the range of about 2400 MHz to about 2483.5 MHz, or including a third ISM band in the range of about 5725 MHz to about 5825 MHz, among other ranges of frequencies.

OVERVIEW

A printed circuit board assembly (PCBA), such as including a wireless communication circuit, can include a planar antenna. Such a planar antenna can be formed (e.g., patterned, etched, deposited, etc.) using a conductive material that can also be used for forming various other electrical or mechanical interconnections of the circuit board. The present invent has recognized, among other things, that such a planar antenna can be cheaper to fabricate or more volumetrically compact as compared to using a separate antenna component that is soldered or otherwise attached to the circuit board.

For example, a soldered antenna component can have a dielectric substrate separate from the printed circuit board substrate, undesirably increasing dielectric loss as compared to a planar antenna formed on the printed circuit board itself. The present inventor has also recognized that forming a planar antenna on the printed circuit board can eliminate one or more interconnects, providing lower insertion loss as compared to using a separate antenna component attached to the substrate.

In one approach, a planar inverted-F antenna (PIFA) can be formed on a printed circuit board. However, such a planar inverted-F antenna can have a relatively narrow usable range of operating frequencies, such as corresponding to quarter-wavelength resonance of the arm of the inverted-F antenna. The present inventor has recognized, among other things, that a planar antenna can instead include two conductive portions or arms, such as located parallel to each other and laterally separated by a specified distance.

The two conductive portions can each include a respective resonant frequency, and such resonant frequencies can be offset from each other, such as to provide a wider usable bandwidth than an inverted-F antenna including only a single arm. Such a double-resonant configuration can provide enhanced immunity to near-field loading or temperature drift, as compared to a narrow-band PIFA configuration. Also, the present inventor has recognized that a linear antenna configuration, such as an inverted-F configuration, can have an unwanted null in a direction parallel to the arm of the inverted-F configuration. The present inventor has recognized, among other things, that if the arms of the planar antenna instead follow a path that can include at least one bend, one or more null locations can be shifted to a desired azimuth or direction in the plane of the planar antenna.

The present inventor has also recognized that the planar antenna can include a feed portion, such as including a printed circuit board trace. At least some of the feed portion can be located laterally between two portions of a return plane, such as to provide a "slot return" structure that can be used to adjust the input impedance of the planar antenna. For example, the printed circuit board trace can provide an inductive contribution to the input impedance of the planar antenna.

A planar antenna, such as included as a portion of a wireless communication assembly, can include a dielectric portion, a first conductive portion, extending along a surface of the dielectric portion, and a second conductive portion, parallel to the first conductive portion, extending along the surface of the dielectric portion, the second conductive portion laterally offset from the first portion to provide a specified lateral separation between the first and second conductive portions. The first and second conductive portions can be configured to provide respective resonant operating frequencies ranges offset from each other, and the first and second conductive portions can be configured to follow a commonly-shared path, including at least one bend, along the surface of the dielectric portion.

This overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
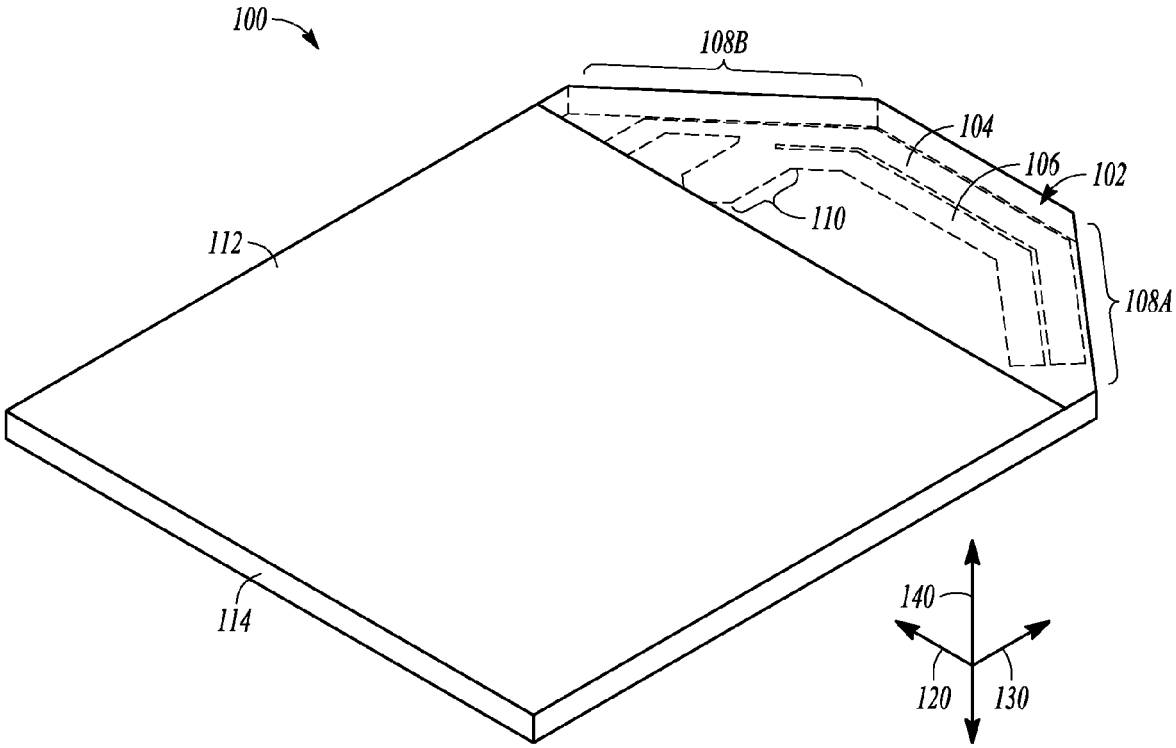
FIG. 1 illustrates generally an example of a printed circuit board assembly that can include a planar antenna.

FIG. 1 illustrates generally an example of a printed circuit board assembly (PCBA) 100 that can include a planar antenna 102. In the example of FIG. 1, the planar antenna 102 can include a first conductive portion 106 and a second conductive portion 104, such as located on a surface of a dielectric portion 114 of the PCBA 100. In an example, the antenna 102 can be driven via a feed conductor 110, such as via a matching structure or other circuitry included as a portion of the printed circuit board assembly 100.

In the example of FIG. 1, the first conductive portion 106 and the second conductive portion 104 can be separated by a specified lateral separation, and can follow a commonly-shared path extending along the surface of the dielectric portion 114. The path can include a portion parallel to a first hypothetical axis 120, and at least one bend. In the example of FIG. 1, the first and second conductive portions 106 and 104 include a first bend, such as to provide a first region 108A where the first conductive portion 106 and the second conductive portion 104 follow a chamfered edge of the PCBA 100. Similarly, the first and second conductive portions 106 and 104 can include a second bend, such as to provide a second region 108B following another chamfered edge of the printed circuit board assembly 100. The present inventor has recognized, among other things, that a planar antenna having conductive portions parallel to only the first axis 120 can produce unwanted nulls or dead-spots in the antenna 102 radiation pattern in the two directions parallel to the first axis 120. The first and second regions 108A-B can move such nulls more toward the circuitry region 112 of the PCBA 100, such as to provide enhanced radiation in both the direction of the first axis 120 and a second hypothetical axis 130, as compared to a purely linear antenna configuration. An illustrative example of a radiation plot showing the two adjusted null locations is simulated and shown in FIG. 5. While the example of FIG. 1 includes a piece-wise linear first conductive portion 106 and second conductive portion 104, the first and second conductive portions 106 and 104 need not be piece-wise linear and can instead follow a curved path.

The circuitry region 112 of the PCBA 100 can include a return plane (e.g., a copper fill pattern or planar copper portion), such as in the circuitry region 112 laterally located or surrounding at least some components or printed wiring traces. Such a plane can provide a counterpoise or pathway for currents to return to a wireless communication circuit included as a portion of the printed circuit board assembly 100. In an example, in the region underneath the antenna 102 (e.g., on a surface of the PCBA opposite the antenna 102 conductors), the plane can be "pulled back" so that there is little or no copper in the layer or layers underneath the antenna 102. Such a configuration can allow the antenna 102 to more effectively radiate or receive energy in the direction of a third hypothetical axis 140 (e.g., a "z" axis), as compared to allowing copper fill to penetrate into the region underneath the antenna 102.

In the example of FIG. 1, the first and second conductive portions 106 and 104 can be tied together at a location at or near the feed conductor 110. In an example, the second conductive portion 104 can include a return conductor electrically coupling the second portion 104 to a return conductor or plane, such as located in the circuitry region 112.

In an example, the dielectric portion 114 of the PCBA can include a glass-epoxy laminate such as FR-4, or one or more other materials, such as generally used for printed circuit board (PCB) fabrication. Such materials can include a bismaleimide-triazine (BT) material, a cyanate ester, a polyimide material, or a polytetrafluoroethylene material, or one or more other materials. One or more of the conductive portions of the PCBA 100 can include electrodeposited or rolled-annealed copper, such as patterned using a photolithographic process, or formed using one or more other techniques (e.g., a deposition, a stamping, etc.)

In an example, the first conductive portion 106 and the second conductive portion 104 can have slightly different effective electrical lengths. For example, the first conductive portion 106 (e.g., a first resonant "arm") can have a path length or electrical length corresponding to a first resonant operating frequency. Similarly, the second conductive portion 104 (e.g., a second resonant "arm") can have a path length or electrical length corresponding a second, different, resonant operating frequency. In an example, the first and second resonant operating frequencies can be offset from each other, such as at least partially overlapping. Such an overlapping "dual-resonant" or "double-resonant" configuration can provide a wideband planar antenna, such as including a usable range of frequencies that is 300 MHz wide or wider, such as shown in the illustrative example of the return loss simulated in FIG. 4.

Figure 2:
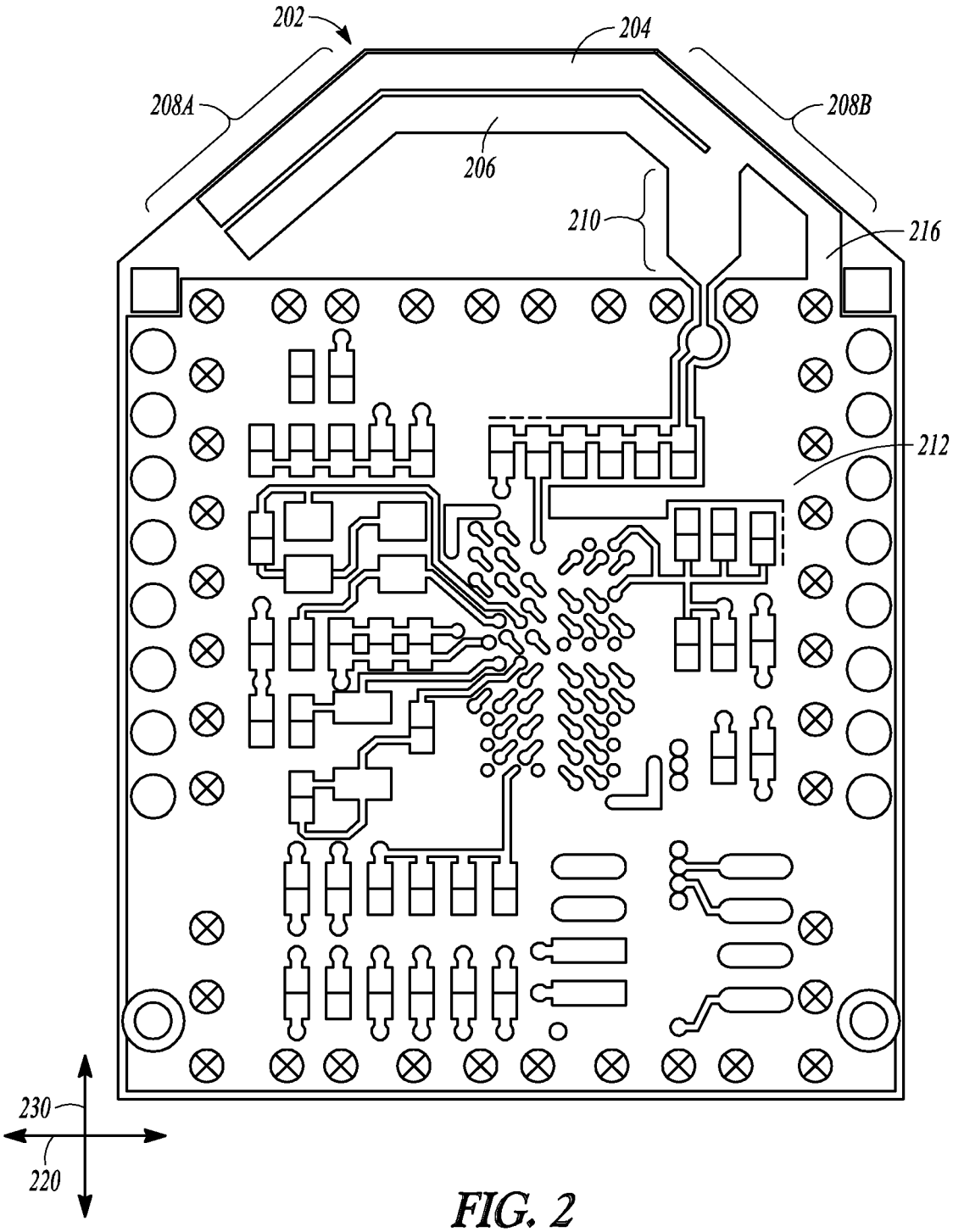
FIG. 2 illustrates generally an example of a conductive pattern that can include a planar antenna pattern, such as included as a portion of a printed circuit board assembly.

FIG. 2 illustrates generally an example of a conductive pattern 200, that can include a planar antenna pattern 202, such as included as a portion of a printed circuit board assembly (PCBA) as shown in the example of FIG. 1. In the example of FIG. 2, a first conductive portion 206 can extend along a plane, such as a plane defined by a first hypothetical axis 220, and a second hypothetical axis 230. Similar to the example of FIG. 1, the first and second conductive portions 206 and 204 can be laterally offset from each other, such as by a specified lateral separation distance (e.g., to form a slot or gap between the two conductors as shown in the examples of FIGS. 1-2). The slot or gap geometry between the first and second conductive portions 206 and 204 can be used, for example, to adjust an input impedance or usable bandwidth of a planar antenna including the antenna pattern 202, such as by influencing the degree of mutual coupling or loading between the laterally adjacent conductive portions 206 and 204. For example, one or more of the gap size, the first conductive portion 206 width, or the second conductive portion 204 width can be varied parametrically to achieve a desired input impedance across a desired range of operating frequencies, such as using a full-wave electromagnetic simulation software (e.g., Ansoft High-Frequency Structure Simulator (HFSS), available from ANSYS, Incorporated, Canonsburg, Pa., U.S.A.).

In an example, the antenna pattern 202 can be electrically coupled to a feed conductor 210, such as at or near a tie location conductively coupling the first and second conductive portions 206 and 204 to each other. In an example, the first and second conductive portions 206 and 204 can include one or more bends, such as to provide a first region 208A and a second region 208B configured to provide radiation in the direction of the first axis 220 (e.g., shifting one or more null locations more toward the direction of a circuitry region 212 of the conductive pattern).

In an example, one or more of the width, location of the feed conductor 210 can be used to adjust an input impedance of a planar antenna including the planar antenna pattern 202, such as shown in FIG. 1. For example, the circuitry region 212 (e.g., illustrated generally in FIG. 2) can include a conductive fill or plane region (e.g., forming a return plane on the PCBA as discussed above in the example of FIG. 1). Such a fill or plane region, as shown in FIG. 2, can at least partially surround a portion of the feed, or can be located laterally separated from the feed conductor 210, such as to provide a "slot return" that can be used to adjust an input impedance of the planar antenna to provide a desired or specified input impedance within a desired or specified range of operating frequencies. For example, the planar antenna pattern 202 can be configured to provide a range of operating frequencies including a range from about 2400 MHz or less to about 2483 MHz or more, such as shown in the illustrative example of FIG. 3. In an illustrative example, such a range of frequencies can correspond to a circuitry region 212 of approximately 0.96 inches (e.g., about 2.4384 centimeters) in width along the first axis 220, and approximately 1.3 inches (e.g., about 3.302 centimeters) in length along the second axis 230.

In an example, the feed conductor 210 can be coupled to other circuitry, such as a wireless communication circuit, via one or more matching components included as a portion of a matching network or structure, such as using one or more interconnects or landing pads provided by the circuitry region 212. In an example, the feed conductor 210 can include a tapered portion (e.g., providing a first lateral width at a first location transitioning to a second lateral width at a second location). Such a tapered lateral width can decrease an impedance discontinuity associated with the transition from a coplanar waveguide or microstrip section located in the circuitry region 212, to the first or second conductive portions 206 or 204.

In an example, the conductive pattern 200 can be included as a portion of a wireless communication circuit assembly (e.g., including both interconnects or landing pads for one or more soldered or electrically attached components, along with the planar antenna pattern 202). Such a conductive pattern 200 can be formed on a conductive layer (e.g., a copper or other conductive layer) of a printed circuit board assembly, such as discussed above in FIG. 1, or elsewhere below. In such a wireless communication circuit assembly example, the circuitry region 212 can include one or more electrical components soldered or otherwise attached to the circuit board assembly, the circuit board assembly including the conductive pattern 200 (or one or more other conductive layers).

Figure 3:
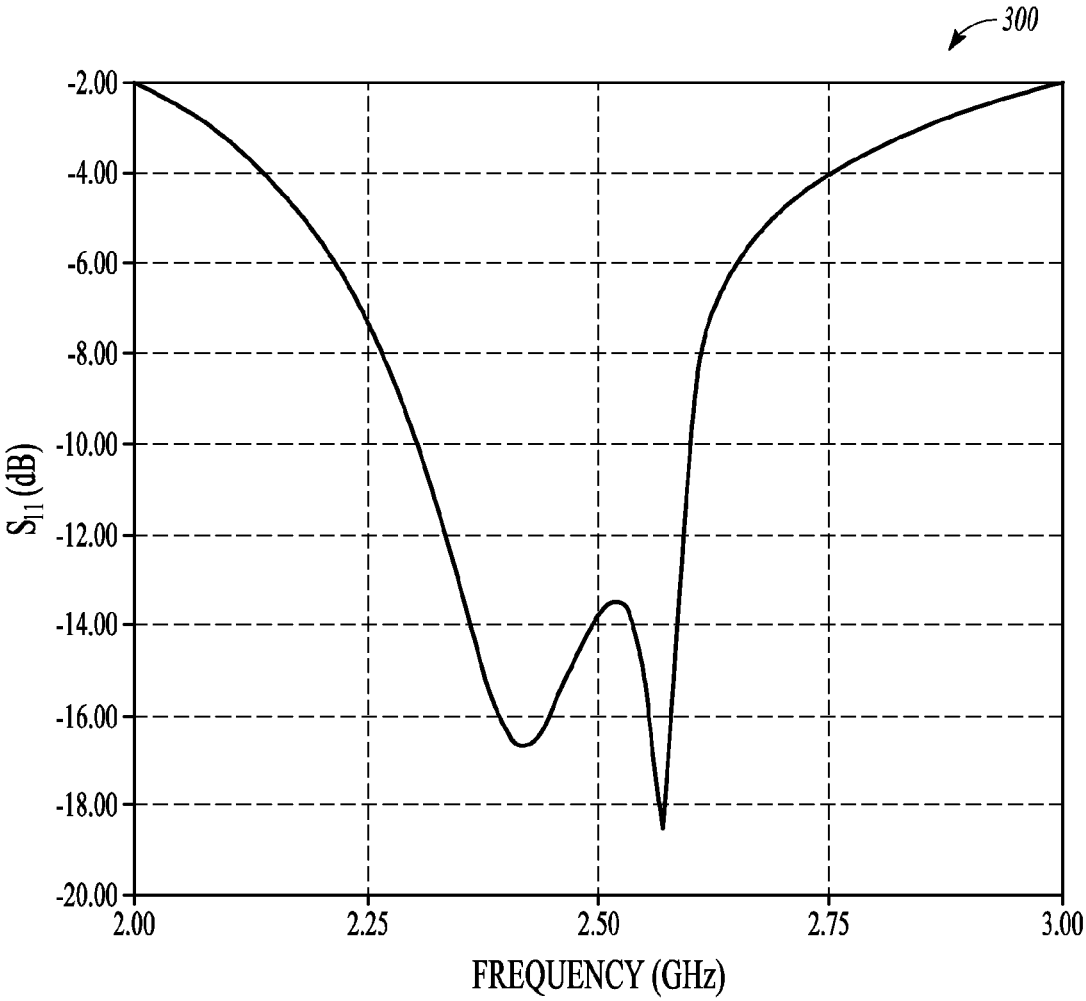
FIG. 3 illustrates generally an illustrative example of a return loss simulated for the antenna configuration of FIGS. 1-2.

FIG. 3 illustrates generally an illustrative example of a return loss 300 simulated for the antenna configuration of FIGS. 1-2. In this illustrative example, a double-resonant response is shown, such as corresponding to the looping impedance shown in the Smith Chart of FIG. 4. In the example of FIG. 3, a usable range of frequencies can include a range from less than about 2300 MHz to more than about 2600 MHz, such as corresponding to a specified $S_{11}$ parameter of about −10 dB or lower (e.g., a return loss of 10 dB, or a voltage standing wave ratio (VSWR) of 2:1 or less), or one or more other values. As discussed above in the examples of FIGS. 1-2, such a double resonant response can correspond to two overlapping resonant responses provided by a respective first conductive portion and a second conductive portion. One or more of a length, width, or separation between conductive portions can be used to adjust or alter the return loss response 300, such as to provide a desired or specified range of operating frequencies over which an input impedance approaches a desired input impedance (e.g., 50 ohms real, or some other impedance). In the example of FIG. 3, the usable range of operating frequencies can be 300 MHz wide or wider, such as including a range from about 2400 MHz to about 2483 MHz. In an example, the planar antenna configuration of FIGS. 1-2 can be scaled, such as reduced in size for use in a different range of frequencies (e.g., at around 5000 MHz, or including one or more other ranges of frequencies).

Such a wideband respond can help reduce the antenna's sensitivity to temperature or mounting configuration. Generally, an antenna including a resonant element can "pull" in response to changing conditions in the near-field environment surrounding the antenna (e.g., due to the presence of a return or ground structures or other conductors, scatterers, or inhomogeneities in the dielectric environment surrounding or nearby the antenna, or due to temperature variation). Such "pull" can distort a radiation pattern of the antenna, or can undesirably shift the "matched" range of frequencies away from the desired operating frequency range. Such behaviors can consume a greater portion of the available link budget at the system level, or can cause unwanted dropouts or inconsistent antenna performance observed at the system level.

The present inventor has recognized, among other things, that using a planar antenna included as a portion of a printed circuit board assembly (PCBA) as discussed in the examples of FIGS. 1-2, having a wideband response such as shown in the simulation of FIG. 3, can be less sensitive to such "pull" from the surrounding environment, as compared to other antenna configurations (e.g., as compared to using a separate narrow-band fractal antenna module soldered to the circuit board assembly). The examples of FIGS. 1-2 can include a planar antenna having a near-field environment dominated by the printed circuit board dielectric or an adjacent return plane, desensitizing the antenna to changes in the surrounding environment, or, in the case where the range of usable operating frequencies is still shifted, for the examples of FIGS. 1-2, such a shifted range still includes the desired range of operating frequencies.

Figure 4:
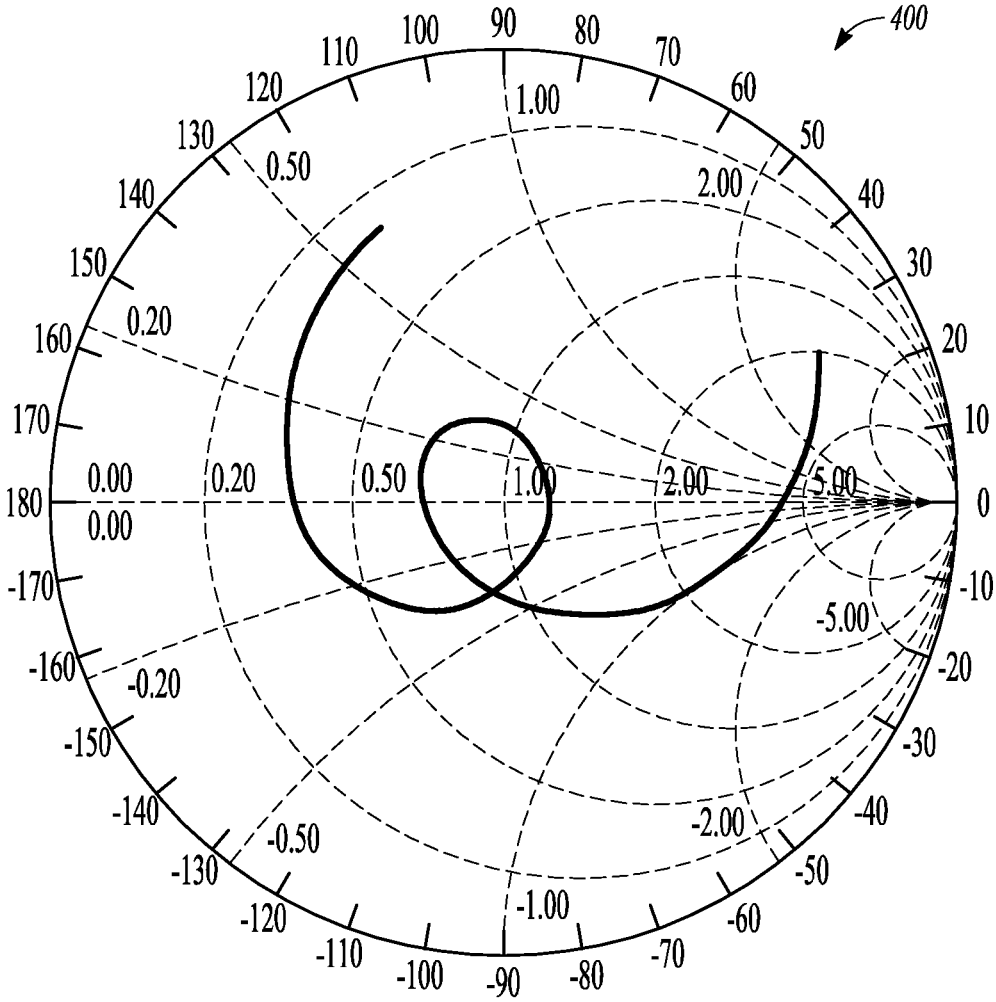
FIG. 4 illustrates generally an illustrative example of an impedance Smith Chart simulated for the antenna configuration of FIGS. 1-2.

FIG. 4 illustrates generally an illustrative example 400 of an impedance Smith Chart simulated for the antenna configurations of FIGS. 1-2. In the example of FIG. 4, a loop in the impedance response can be provided by a double-resonant antenna structures, such as shown in the simulated return loss of the illustrative example of FIG. 3. In the example of FIG. 4, the loop of the impedance surrounds the center or unit impedance of the chart (e.g., corresponding to 50 ohms real impedance). As discussed above with respect FIGS. 1-2, the geometry of the first or second conductive portions can be parametrically studied via simulation to achieve a desired input impedance. In the case where the desired input impedance is not easily achieved, a matching structure such as one or more discrete or distributed matching components can be used to minimize or reduce the impedance discontinuity between the antenna and a wireless communication circuit coupled to the antenna via the matching structure, or to adjust the input impedance presented to the wireless communication circuit.

Figure 5:
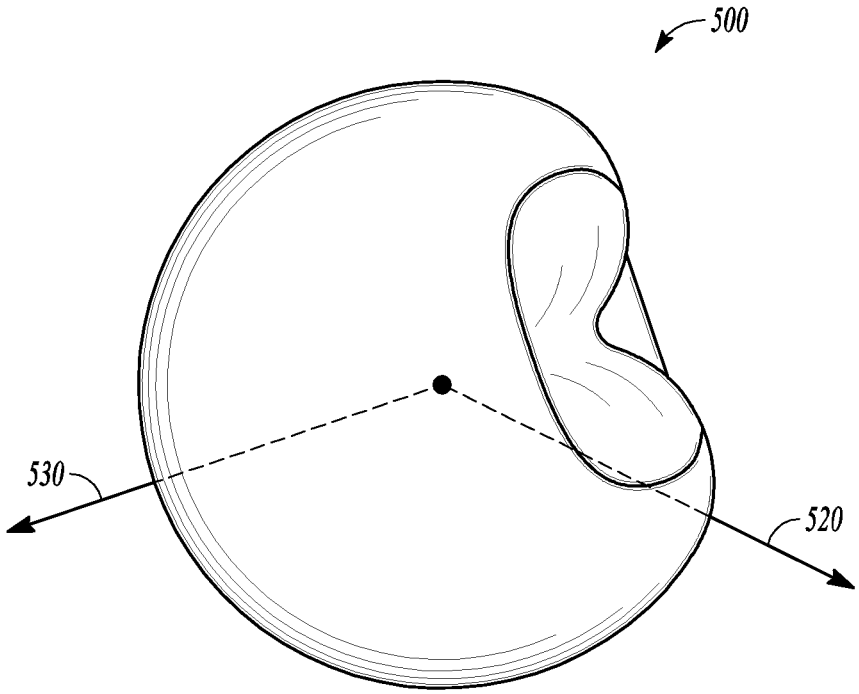
FIG. 5 illustrates generally an illustrative example of a three-dimensional radiation pattern simulated for the antenna configuration of FIGS. 1-2.

FIG. 5 illustrates generally an illustrative example of a three-dimensional radiation pattern 500 simulated for the antenna configuration of FIGS. 1-2. In the region along a second hypothetical axis 530 (e.g., similar to the second hypothetical axis 130 or 230 of FIGS. 1-2), a "bore sight" gain of the antenna can be around −1 dBi (e.g., −1 decibels as compared to an isotropic radiator). Unlike a purely linear antenna configuration (e.g., providing a toroidal radiation pattern such as including strong nulls in the direction of a first hypothetical axis 520), the illustrative example of FIG. 5 includes a "double dimple" shifted to a direction opposite the bore sight. In an example, these dimples or null locations can be located in the shadow of the antenna such as in the direction of a shield, other circuitry, such as one or more of the circuitry regions 112 or 212 shown in FIGS. 1-2. Such shifting of the null locations can allow more radiation in the direction of the first hypothetical axis 520 (e.g., similar to the first hypothetical axis 120 or 220 of FIGS. 1-2), as compared to a purely linear antenna configuration. As discussed above in the examples of FIGS. 1-2, such dimples or null locations can be adjusted or provided at least in part by one or more bends along the path of one or more conductors of the planar antenna.

Figure 6:
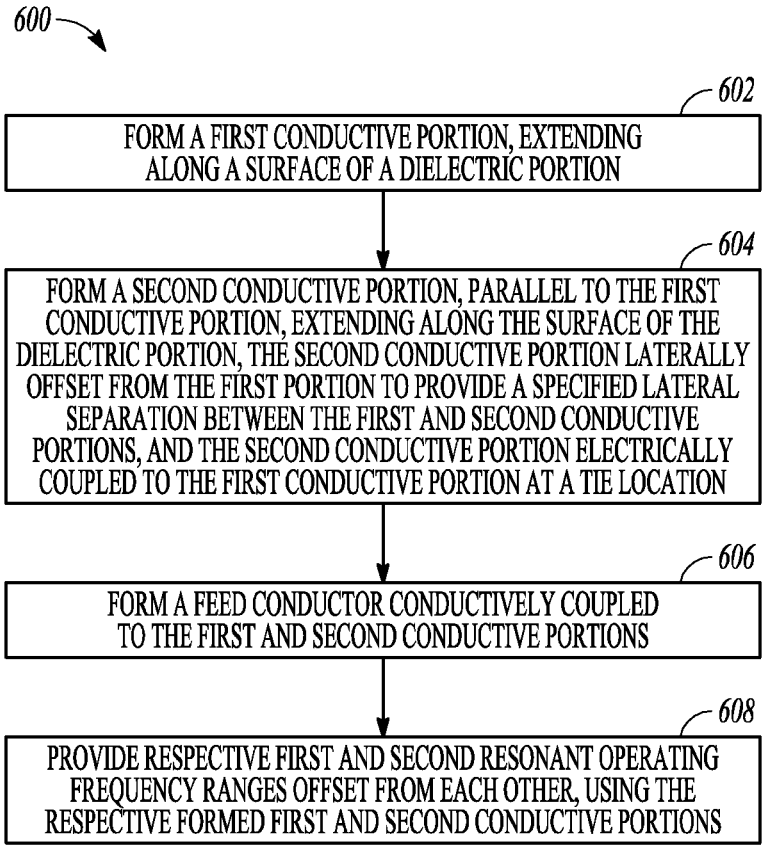
FIG. 6 illustrates generally a technique that can include forming a planar antenna, such as included as a portion of a printed circuit board assembly.

FIG. 6 illustrates generally a technique 600 that can include forming a planar antenna, such as included as a portion of a printed circuit board assembly. In an example, at 602, the technique 600 can include forming a first conductive portion, extending along a surface of a dielectric portion. For example, the first conductive portion can include a copper region on a layer of a printed circuit board assembly, such as discussed above in the examples of FIGS. 1-5, and the dielectric portion can be a substrate of such a circuit board assembly.

At 604, the technique 600 can include forming a second conductive portion parallel to the first conductive portion, extending along the surface of the dielectric portion, the second conductive portion laterally offset from the first portion such as to provide a specified lateral separation between the first and second conductive portions. In an example, the second portion can be electrically coupled to the first conductive portion at a tie location, such as shown in the examples of FIGS. 1-5. In an example, the first or second conductive portions can be patterned (e.g., using a lithographic process such as including a patterning and an etching technique), or can be otherwise formed, stamped, cut, deposited, or the like.

At 606, the technique 600 can include forming a feed conductor conductively coupled to the first and second conductive portions, such as shown in the examples of FIGS. 1-5. At 608, the technique 600 can include providing respective first and second resonant operating frequency ranges offset from each other, using the respective formed first and second conductive portions.

VARIOUS EXAMPLES AND NOTES

Example 1 includes subject matter (such as an apparatus) comprising a planar antenna including dielectric portion, a first conductive portion, extending along a surface of the dielectric portion, a second conductive portion, parallel to the first conductive portion, extending along the surface of the dielectric portion, the second conductive portion laterally offset from the first portion to provide a specified lateral separation between the first and second conductive portions, and a feed conductor conductively coupled to the first and second conductive portions. In Example 1, the first and second conductive portions are conductively coupled at a tie location, the first and second conductive portions are configured to provide respective first and second resonant operating frequency ranges, the resonant operating frequencies ranges offset from each other, the first and second conductive portions are configured to follow a commonly-shared path, including at least one bend, along the surface of the dielectric portion, and the second conductor includes a return conductor extending along the surface of the dielectric portion between the second conductive portion and a return plane.

In Example 2, the subject matter of Example 1 can optionally include a dielectric portion comprising a rigid printed circuit board substrate.

In Example 3, the subject matter of one or any combination of Examples 1-2 can optionally include a rigid printed circuit board substrate comprising a glass-epoxy laminate, and the first and second conductive portions respectively comprise copper regions mechanically coupled to the printed circuit board substrate.

In Example 4, the subject matter of one or any combination of Examples 1-3 can optionally include a feed conductor comprising a printed circuit board trace configured to adjust an input impedance of the planar antenna to provide a specified input impedance corresponding to a specified range of frequencies.

In Example 5, the subject matter of one or any combination of Examples 1-4 can optionally include a feed conductor comprising a printed circuit board trace configured to provide an inductive contribution to the input impedance of the planar antenna.

In Example 6, the subject matter of one or any combination of Examples 1-5 can optionally include a specified range of frequencies comprising a range from about 2400 MHz to about 2483 MHz.

In Example 7, the subject matter of one or any combination of Examples 1-6 can optionally include a feed conductor configured to be coupled to a terminal of a wireless communication circuit via a matching structure, the matching structure configured to provide a specified input impedance corresponding to a specified range of frequencies.

In Example 8, the subject matter of one or any combination of Examples 1-7 can optionally include a tie location located along the length of the first and second conductive portions at about the same location as the feed conductor.

In Example 9, the subject matter of one or any combination of Examples 1-8 can optionally include respective first and second resonant operating frequency ranges that can at least partially overlap.

Example 10 includes subject matter (such as apparatus) comprising a wireless communication assembly, including a printed circuit board comprising a dielectric portion and a planar antenna, and a wireless communication circuit electrically and mechanically coupled to the printed circuit board and the planar antenna, and configured to wirelessly transfer information electromagnetically using the planar antenna and one or more electrical interconnections provided by the printed circuit board. In Example 10, the planar antenna comprises a first conductive portion, extending along a surface of the dielectric portion, a second conductive portion, parallel to the first conductive portion, extending along the surface of the dielectric portion, the second conductive portion laterally offset from the first portion to provide a specified lateral separation between the first and second conductive portions, and a feed conductor conductively coupled to the first and second conductive portions. In Example 10, the first and second conductive portions are conductively coupled at a tie location, the first and second conductive portions are configured to provide respective first and second resonant operating frequency ranges, the resonant operating frequency ranges offset from each other, the first and second conductive portions are configured to follow a commonly-shared path, including at least one bend, along the surface of the dielectric portion, and the second conductor includes a return conductor extending along the surface of the dielectric portion between the second conductive portion and a return plane.

In Example 11, the subject matter of Example 10 can optionally include a dielectric portion comprising a rigid printed circuit board substrate.

In Example 12, the subject matter of one or any combination of Examples 10-11 can optionally include a rigid printed circuit board substrate comprising a glass-epoxy laminate, and the first and second conductive portions respectively comprise copper regions mechanically coupled to the printed circuit board substrate.

In Example 13, the subject matter of one or any combination of Examples 10-12 can optionally include a feed conductor comprising a printed circuit board trace configured to adjust an input impedance of the planar antenna to provide a specified input impedance corresponding to a specified range of frequencies.

In Example 14, the subject matter of one or any combination of Examples 10-13 can optionally include a feed conductor comprising a printed circuit board trace configured to provide an inductive contribution to the input impedance of the planar antenna.

In Example 15, the subject matter of one or any combination of Examples 10-14 can optionally include a specified range of frequencies including a range from about 2400 MHz to about 2483 MHz.

In Example 16, the subject matter of one or any combination of Examples 10-15 can optionally include a feed conductor configured to be coupled to a terminal of the wireless communication circuit via a matching structure, the matching structure configured to provide a specified input impedance corresponding to a specified range of frequencies.

In Example 17, the subject matter of one or any combination of Examples 10-16 can optionally include respective first and second resonant operating frequency ranges that can at least partially overlap.

Example 18 can include, or can optionally be combined with the subject matter of one or any combination of Examples 1-17 to include, subject matter (such as a method, a means for performing acts, or a machine-readable medium including instructions that, when performed by the machine, cause the machine to perform acts) comprising forming a planar antenna, including forming a first conductive portion, extending along a surface of a dielectric portion, forming a second conductive portion, parallel to the first conductive portion, extending along the surface of the dielectric portion, the second conductive portion laterally offset from the first portion to provide a specified lateral separation between the first and second conductive portions, and the second conductive portion electrically coupled to the first conductive portion at a tie location, forming a feed conductor conductively coupled to the first and second conductive portions, and providing respective first and second resonant operating frequency ranges offset from each other, using the respective formed first and second conductive portions. In Example 18, the forming the first and second conductive portions includes forming the respective first and second conductive portions along a commonly-shared path, including at least one bend, along the surface of the dielectric portion, and the second conductor includes a return conductor extending along the surface of the dielectric portion between the second conductive portion and a return plane.

In Example 19, the subject matter of Example 18 can optionally include adjusting an input impedance of the planar antenna to provide a specified input impedance corresponding to a specified range of frequencies using the feed conductor, and the feed conductor comprises a printed circuit board trace.

In Example 20, the subject matter of one or any combination of Examples 18-19 can optionally include at least one of the forming the first conductive portion, the forming the second conductive portion, or the forming the feed conductor comprising forming a conductive layer of a printed circuit board assembly, and the dielectric portion comprises a dielectric substrate of the circuit board assembly.

Example 21 can include, or can optionally be combined with any portion or combination of any portions of any one or more of Examples 1-20 to include, subject matter that can include means for performing any one or more of the functions of Examples 1-20, or a machine-readable medium including instructions that, when performed by a machine, cause the machine to perform any one or more of the functions of Examples 1-20.

These non-limiting examples can be combined in any permutation or combination.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventor also contemplates examples in which only those elements shown or described are provided. Moreover, the present inventor also contemplates examples using any combination or permutation of those elements shown or described (or one or more aspects thereof), either with respect to a particular example (or one or more aspects thereof), or with respect to other examples (or one or more aspects thereof) shown or described herein.

All publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document; for irreconcilable inconsistencies, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The claimed invention is:

1. A planar antenna, comprising:

a dielectric portion;

a first conductive portion, extending along a surface of the dielectric portion;

a second conductive portion, parallel to the first conductive portion, extending along the surface of the dielectric portion, the second conductive portion laterally offset from the first portion to provide a specified lateral separation between the first and second conductive portions; and a feed conductor conductively coupled to the first and second conductive portions;

wherein the first and second conductive portions are conductively coupled at a tie location;

wherein the first and second conductive portions are configured to provide respective first and second resonant operating frequency ranges, the resonant operating frequencies ranges offset from each other;

wherein the first and second conductive portions are configured to follow a commonly-shared path, including at least one bend, along the surface of the dielectric portion; and wherein the second conductor includes a return conductor extending along the surface of the dielectric portion between the second conductive portion and a return plane.

2. The planar antenna of claim 1, wherein the dielectric portion includes a rigid printed circuit board substrate.

3. The planar antenna of claim 2, wherein the rigid printed circuit board substrate includes a glass-epoxy laminate;

and wherein the first and second conductive portions respectively comprise copper regions mechanically coupled to the printed circuit board substrate.

4. The planar antenna of claim 1, wherein the feed conductor comprises a printed circuit board trace configured to adjust an input impedance of the planar antenna to provide a specified input impedance corresponding to a specified range of frequencies.

5. The planar antenna of claim 4, wherein the printed circuit board trace provides an inductive contribution to the input impedance of the planar antenna.

6. The planar antenna of claim 4, wherein the specified range of frequencies includes a range from about 2400 MHz to about 2483 MHz.

7. The planar antenna of claim 4, wherein the feed conductor is configured to be coupled to a terminal of a wireless communication circuit via a matching structure, the matching structure configured to provide a specified input impedance corresponding to a specified range of frequencies.

8. The planar antenna of claim 1, wherein the tie location is located along the length of the first and second conductive portions at about the same location as the feed conductor.

9. The planar antenna of claim 1, wherein the respective first and second resonant operating frequency ranges at least partially overlap.

10. A wireless communication assembly, comprising:

a printed circuit board comprising a dielectric portion and a planar antenna; and a wireless communication circuit electrically and mechanically coupled to the printed circuit board and the planar antenna, and configured to wirelessly transfer information electromagnetically using the planar antenna and one or more electrical interconnections provided by the printed circuit board;

wherein the planar antenna comprises:

a first conductive portion, extending along a surface of the dielectric portion;

a second conductive portion, parallel to the first conductive portion, extending along the surface of the dielectric portion, the second conductive portion laterally offset from the first portion to provide a specified lateral separation between the first and second conductive portions;

a feed conductor conductively coupled to the first and second conductive portions;

wherein the first and second conductive portions are conductively coupled at a tie location;

wherein the first and second conductive portions are configured to provide respective first and second resonant operating frequency ranges, the resonant operating frequency ranges offset from each other;

wherein the first and second conductive portions are configured to follow a commonly-shared path, including at least one bend, along the surface of the dielectric portion; and wherein the second conductor includes a return conductor extending along the surface of the dielectric portion between the second conductive portion and a return plane.

11. The wireless communication assembly of claim 10, wherein the dielectric portion includes a rigid printed circuit board substrate.

12. The wireless communication assembly of claim 11, wherein the rigid printed circuit board substrate includes a glass-epoxy laminate;

and wherein the first and second conductive portions respectively comprise copper regions mechanically coupled to the printed circuit board substrate.

13. The wireless communication assembly of claim 10, wherein the feed conductor comprises a printed circuit board trace configured to adjust an input impedance of the planar antenna to provide a specified input impedance corresponding to a specified range of frequencies.

14. The wireless communication assembly of claim 13, wherein the printed circuit board trace provides an inductive contribution to the input impedance of the planar antenna.

15. The wireless communication assembly of claim 13, wherein the specified range of frequencies includes a range from about 2400 MHz to about 2483 MHz.

16. The wireless communication assembly of claim 13, wherein the feed conductor is configured to be coupled to a terminal of the wireless communication circuit via a matching structure, the matching structure configured to provide a specified input impedance corresponding to a specified range of frequencies.

17. The wireless communication assembly of claim 10, wherein the respective first and second resonant operating frequency ranges at least partially overlap.

18. A method for forming a planar antenna, comprising:

forming a first conductive portion, extending along a surface of a dielectric portion;

forming a second conductive portion, parallel to the first conductive portion, extending along the surface of the dielectric portion, the second conductive portion laterally offset from the first portion to provide a specified lateral separation between the first and second conductive portions, and the second conductive portion electrically coupled to the first conductive portion at a tie location;

forming a feed conductor conductively coupled to the first and second conductive portions; and providing respective first and second resonant operating frequency ranges offset from each other, using the respective formed first and second conductive portions;

wherein the forming the first and second conductive portions includes forming the respective first and second conductive portions along a commonly-shared path, including at least one bend, along the surface of the dielectric portion; and wherein the second conductor includes a return conductor extending along the surface of the dielectric portion between the second conductive portion and a return plane.

19. The method of claim 18, comprising adjusting an input impedance of the planar antenna to provide a specified input impedance corresponding to a specified range of frequencies using the feed conductor; and wherein the feed conductor comprises a printed circuit board trace.

20. The method of claim 18, wherein at least one of the forming the first conductive portion, the forming the second conductive portion, or the forming the feed conductor includes forming a conductive layer of a printed circuit board assembly; and wherein the dielectric portion comprises a dielectric substrate of the circuit board assembly.

* * * * *